US005399815A

United States Patent [19]

Ballarati

[11] Patent Number: 5,399,815

[45] Date of Patent: Mar. 21, 1995

[54] METHOD FOR ON-LINE PROCESS CONTROL OF YARN PACKAGE

[75] Inventor: Vito Ballarati, Como, Italy

[73] Assignee: Val Lesina S.p.A., Sondrio, Italy

[21] Appl. No.: 45,505

[22] Filed: Apr. 8, 1993

[51] Int. Cl.[6] ..... G01G 19/52; G01L 5/04

[52] U.S. Cl. ..... 177/50; 177/145; 73/160

[58] Field of Search ..... 177/50, 145; 73/160

[56] References Cited

U.S. PATENT DOCUMENTS 3,929,013 12/1975 Hendrix et al. ..... 73/160
3,955,637 5/1976 Del Rosso ..... 177/145

FOREIGN PATENT DOCUMENTS 26472 4/1981 European Pat. Off. .
291712 11/1988 European Pat. Off. .
3707552 9/1988 Germany .
4-075974 6/1992 Japan .

*Primary Examiner*—George H. Miller, Jr.
*Attorney, Agent, or Firm*—Abelman, Frayne & Schwab

[57] ABSTRACT

Method for on-line process control of yarns wound upon reels intended for yarn package classification and sorting into homogeneous classes of predetermined quality standards. This method consists in the determination of the specific weight of the yarn bundling on the reel. This value is utilized to check the yarn package compliance with preset standard values of the technological properties, in particular of the dyeing affinity.

3 Claims, 4 Drawing Sheets

METHOD FOR ON-LINE PROCESS CONTROL OF YARN PACKAGE

BACKGROUND OF THE INVENTION

This invention concerns a method for on-line process control of yarns packages i.e. yarn wound upon reels, employing highly automated instruments, in which the analytical data storage and processing for product evaluation are carried out by a preset computer programme.

In this description the term "package" means a bundle of yarns (plain, twisted, texturized, POY, etc.) wound upon a rigid reel, as bobbin, cop, tube, cone.

The term "lot" means a product batch obtained from a given raw material and through a given production process.

STATE OF THE TECHNIQUE

The quality control of yarn packages for the selection and sorting of same into predetermined classes is at present based on a large number of analytical determinations and technological tests, the main being the following:

1) Package weight: determined automatically by mechanical and electronic balances;

2) Degree of interlacing (number of knots/meter): obtained by automatic (Enka, Microdynamics, Lawson-Hemphill) or manual apparatus (vat containing $H_2O$);

3) Gauging: the package external diameter may be determined by various methods based on IR, ultrasound laser, or on mechanical or manual techniques (gauge and snap gauge);

4) Filament defects and other defects: in general, detected visually by the operator;

5) Dyeing affinity: the "sock dyeing" test is largely used. It consists in the preparation of a specimen (a sock manufactured from various packages by a circular knitting machine) and in the subsequent standard dyeing, evaluated by visual control or by optical sensors (colorimeter).

Another test in use consists in yarn continuous dyeing.

The aforesaid tests and analytical determinations require very different performance times: in particular, the dyeing affinity test ("sock dyeing") is time-consuming. It follows that a control apparatus for the simultaneous performance of all predetermined tests can be hardly implemented.

DESCRIPTION OF THE INVENTION

Method of control

The quality control method envisaged in this invention meant for classifying the yarn packages leaving the production plant (spinning, texturizing or other) and sorting same into predetermined quality classes consists in the analytical determinations and technological tests described hereinafter, which are performed by a prescribed computer-based operating programme.

The computer stores and processes the data detected, and defines the classification of the product being examined.

The major analytical determinations envisaged by the programme are:

a) Package weight b) Package external diameter c) Number of knots/meter (interlacing)

d) Filament defects (number of piles) by visual or automatic control e) Hardness of the yarn bundle wound upon the reel, i.e. of the yarn bundling.

The package weight (point a) is determined by an electronic weighing instrument.

The tare, i.e. the weight of the package inner tube, is set to zero at the start.

Therefore, the net weight of the yarn wound upon the reel (i.e. of the yarn bundling) is obtained directly.

The determination as per point b is meant for measuring the yarn bundling volume.

For said determination it is necessary to know some dimensions of the package, which is shown for convenience in FIG. 1.

DETAILED DESCRIPTION OF THE DRAWINGS

Figure 1:
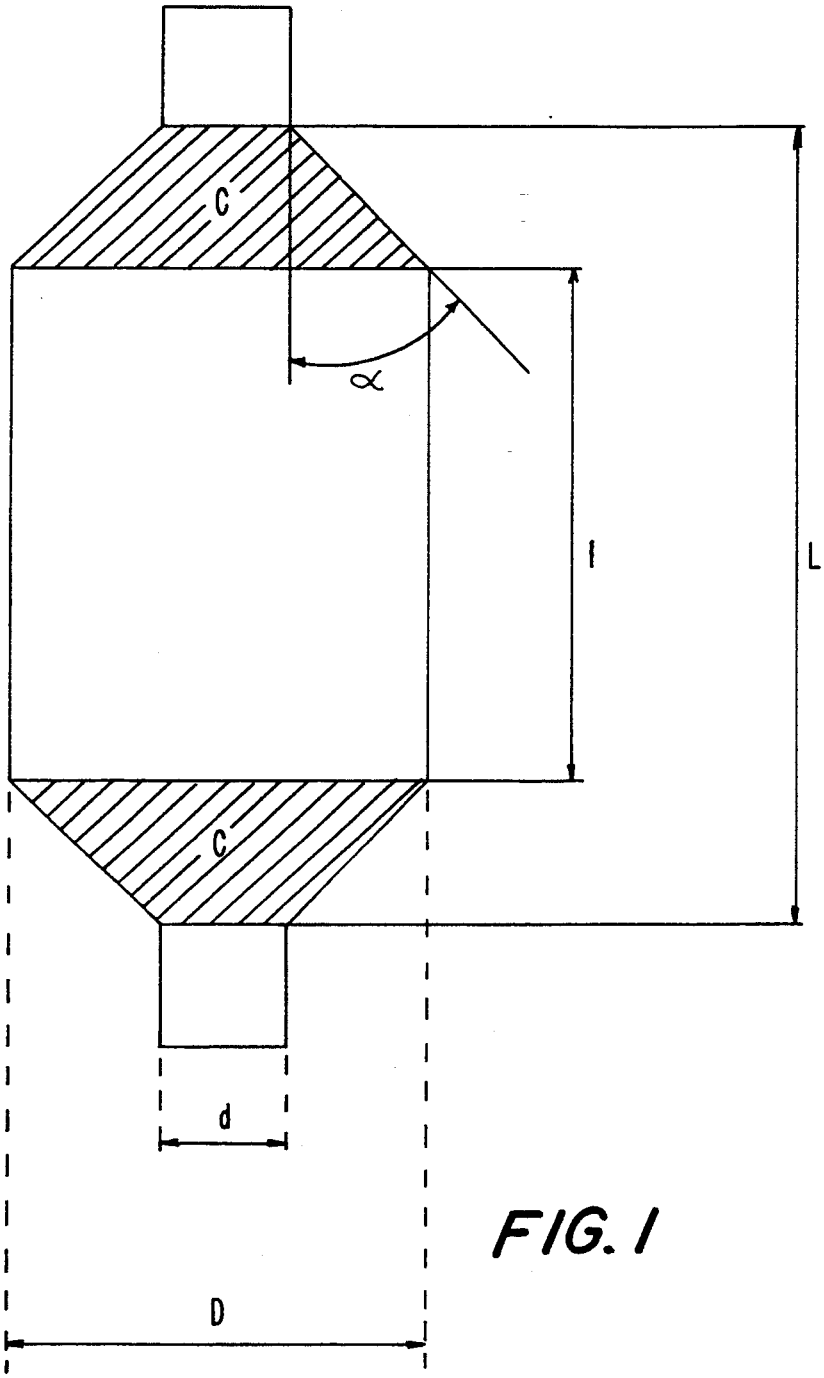
FIG. 1 is a description of the dimensions of a bundle of yarn.

In FIG. 1 the indexes have the following meanings:

L=total yarn bundling length l=yarn bundling length at diameter D

D=max. yarn bundling diameter (or external diameter)

d=tube diameter (tubular reel).

Characteristics of the Dimensions

As concerns the aforesaid dimensions it is to be noted that:

(d) obviously is a constant value known a priori;

(L) is a constant value known a priori (as it depends on the setting of the stroke of the cross-winding device of the winding frame);

(l) can be calculated on the basis of the external diameter D: since the package ends (C) (FIG. 1) are approximately truncated cones and angle $\alpha$ is almost constant within very narrow limits, once the working conditions of the winding frame are set, the value of (l) can be calculated from (L), (D), and (d).

D is measured automatically by a sensor set on the inspection table. As stated above, the value of diameter D being known, it is possible to calculate the value of l and, consequently, of the yarn bundling volume. Obviously, in the case of perfectly cylindrical packages ($\alpha$ angle of 90° in FIG. 1) l will be constant and equal to L. Also in the case of differently shaped packages (e.g. cone-shaped), the yarn bundling volume may be calculated from the value of the external diameter D determined in a convenient position.

The specific weight of the yarn bundling is obtained from the yarn bundling net weight and volume.

In practice, the package net weight being determined, the measurement of the external diameter D allows the determination of the specific weight.

The determination as pep point c) is carried out by known instruments and may be carried out using a Lawson-Hemphill apparatus provided with computer-interfaceable sensors.

The determination as per point e is optional, since hardness—being a defined function of the specific weight—can be evaluated on the basis of the sp. wt. value.

An essential characteristic of this invention is that the values of specific weight and hardness of the yarn bundles wound upon a reel, i.e. of the yarn bundling, are used as parameters for evaluating the yarn compliance with predetermined standards. As a matter of fact, the said values—in particular the specific weight—were surprisingly found to be related to the main technological properties of the yarn.

In particular, the measurement of the specific weight supplies basic information for quality control, which allows the non-performance of the tests related to the dyeing properties, such as the sock dyeing test, which is highly time-consuming and which is feasible only with a very limited sampling of the product to be tested (less than 0.5%), as well as the yarn continuous dyeing test which is highly expensive.

Both the hardness and the specific weight of the yarn bundling are pratically proportional to the yarn winding tension on the reel and, as far as the texturized yarn is concerned, to the degree of crimping.

Should the hardness and specific weight values differ considerably from the average values, the yarn would be defective, and in particular the dyeing affinity would not be homogeneous.

The admissible range of values of said parameters are to be fixed on the basis of the type of product to be examined, of the production procedure, and of the other textile characteristics. In particular, as concerns the specific weight, the standard value and the minimum and maximum admissible limits they can be calculated from the weight and external diameter standard values and from the respective preset minimum and maximum limit values.

It is however possible to make an independent choice of the range of specific weight values, i.e. narrower than the range that may be calculated as stated above.

Table 1 lists some values determined for texturized yarns, PET 83 DTEX, 136 filaments, circular section (polyester without delusterant produced by Rhône Poulenc) obtained from one lot.

In table 1 the meanings of d, D, l, L are those shown in FIG. 1. P is the gross weight, p=net weight, t=tare, SW=specific weight, H=hardness, Tens.=tension, Tenst=theoretical tension, V=volume, vt=theoretical volume.

In practice, the only measurement required is that of the specific weight: hardness can be evaluated to a good approximation on the basis of said value, as a precise correlation exists between hardness and specific weight. Sample 14 shows a too high specific weight, index of an high winding tension.

TABLE 1

| | | | Specific weight-hardness and yarn tensions of bobbins of texturized PET | | | | | | | | | | | | |
|---|---|---|---|---|---|---|---|---|---|---|---|---|---|---|---|
| Sample | d | D | l | L | v | vt | P | t | p | SW | pst | E % | H | Tens | Tenst |
| 1 | 7.6 | 22.1 | 18.1 | 23.8 | 6925.57 | 6933.43 | 3395 | 195 | 3200 | 0.46 | 0.46 | 0.1 | 42 | — | — |
| 2 | 7.6 | 22.8 | 18.1 | 24.2 | 7487.41 | 7381.73 | 3395 | 195 | 3200 | 0.43 | 0.43 | −1.4 | 41 | — | — |
| 3 | 7.6 | 19.2 | 19.5 | 23.9 | 5218.22 | 5164.83 | 3335 | 195 | 3140 | 0.60 | 0.61 | −1.0 | 51 | — | — |
| 4 | 7.6 | 19.3 | 19.2 | 24.1 | 5261.16 | 5223.25 | 3240 | 195 | 3045 | 0.58 | 0.58 | −0.7 | 51 | — | — |
| 5 | 7.6 | 18.5 | 19.0 | 24.0 | 4723.76 | 4761.36 | 2640 | 195 | 2445 | 0.52 | 0.51 | 0.8 | 48 | — | — |
| 6 | 7.6 | 17.9 | 17.5 | 24.2 | 4205.86 | 4423.39 | 2460 | 195 | 2265 | 0.54 | 0.51 | 4.9 | 50 | — | — |
| 7 | 7.6 | 16.4 | 19.8 | 24.1 | 3595.57 | 3611.94 | 2000 | 195 | 1805 | 0.50 | 0.50 | 0.5 | 48 | — | — |
| 8 | 7.6 | 16.6 | 19.7 | 24.0 | 3690.19 | 3717.28 | 2015 | 195 | 1820 | 0.49 | 0.49 | 0.7 | 46 | — | — |
| 9 | 7.6 | 14.9 | 20.3 | 24.1 | 2835.89 | 2851.32 | 1705 | 195 | 1510 | 0.53 | 0.53 | 0.5 | 55 | — | — |
| 10 | 7.6 | 14.5 | 20.6 | 24.1 | 2653.60 | 2657.56 | 1760 | 195 | 1565 | 0.59 | 0.59 | 0.1 | 53 | — | — |
| 11 | 7.6 | 11.1 | 22.2 | 24.2 | 1188.77 | 1177.74 | 910 | 195 | 715 | 0.60 | 0.61 | −0.9 | 60 | — | — |
| 12 | 7.6 | 10.8 | 22.4 | 24.3 | 1076.71 | 1062.38 | 820 | 195 | 625 | 0.58 | 0.59 | −1.3 | 60 | — | — |
| 13 | 7.6 | 13.5 | 21.3 | 23.8 | 2192.31 | 2190.64 | 1575 | 195 | 1380 | 0.63 | 0.63 | −0.1 | 60 | — | — |
| 14 | 7.6 | 11.8 | 22.0 | 24.0 | 1466.51 | 1456.85 | 1365 | 195 | 1170 | 0.80 | 0.80 | −0.7 | 70 | — | — |
| 15 | 7.6 | 19.5 | 17.8 | 24.5 | 5230.09 | 5340.68 | 3210 | 195 | 3015 | 0.58 | 0.56 | 2.1 | 50 | 19 | 18.00 |
| 16 | 7.6 | 19.8 | 16.0 | 24.3 | 5125.93 | 5518.25 | 3230 | 195 | 3035 | 0.59 | 0.55 | 7.1 | 50 | 21.5 | 16.71 |
| 17 | 7.6 | 19.0 | 18.4 | 24.3 | 4981.91 | 5048.56 | 3240 | 195 | 3045 | 0.61 | 0.60 | 1.3 | 50 | 27 | 21.42 |
| 18 | 7.6 | 18.7 | 18.7 | 24.6 | 4866.32 | 4875.64 | 3240 | 195 | 3045 | 0.63 | 0.62 | 0.2 | 55 | 23 | 23.31 |
| 19 | 7.6 | 18.2 | 19.1 | 24.7 | 4619.21 | 4591.45 | 3200 | 195 | 3005 | 0.65 | 0.65 | −0.6 | 55 | 24.9 | 25.96 |
| 20 | 7.6 | 17.8 | 18.5 | 24.5 | 4290.95 | 4367.79 | 3220 | 195 | 3025 | 0.70 | 0.69 | 1.8 | 58 | 29.5 | 29.33 |
| 21 | 7.6 | 19.4 | 17.5 | 24.5 | 5124.60 | 5281.87 | 3205 | 195 | 3010 | 0.59 | 0.57 | 3.0 | 50 | 17 | 18.47 |
| 22 | 7.6 | 21.0 | 17.6 | 24.4 | 6157.96 | 6245.10 | 3275 | 195 | 3060 | 0.50 | 0.49 | 1.4 | 46 | 12.5 | 11.69 |
| 23 | 7.6 | 20.0 | 18.1 | 24.6 | 5605.10 | 5637.57 | 3205 | 195 | 3010 | 0.54 | 0.53 | 0.6 | 45 | 15 | 15.29 |

L mean = 24.1 l theoretical = 25.88 − 0.36 · D

Theoretical tension = −31.96 + 88.50 ps

Figure 2:
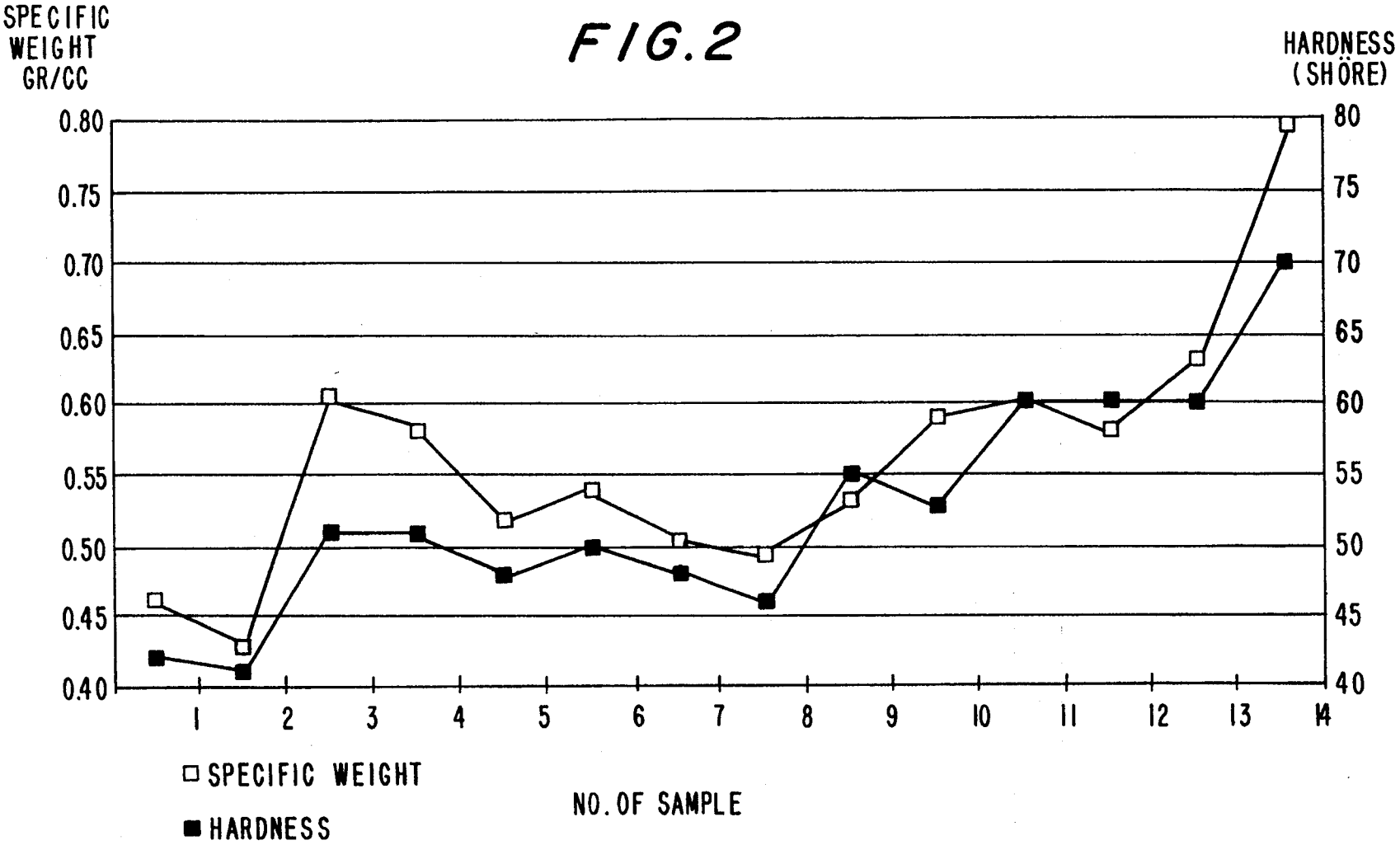
FIG. 2 is a graph illustrating the specific weight and hardness values of 14 samples of texturized yarn as disclosed in Table 1.

The specific weight and hardness values of samples from 1 to 14 of Table 1 are plotted in FIG. 2.

The control method envisaged in this invention has the major advantage that, after ascertaining the close correlation between the yarn bundling specific weight and the main technological properties of the yarn itself (one being the dyeing affinity), only the specific weight is to be measured to check whether a package—as far as said technological properties are concerned—is homogeneous in respect of a quality class of predetermined characteristics, even if the values of the package weight and external diameter D do not fall within the standard range of values fixed for said quality class.

This allows a rational and economically advantageous classification of the packages under examination. It follows that the packages with weight and external diameter values not falling within the standard range, but with technological properties fully acceptable and homogeneous in respect of those predetermined for a given quality class, will not be discarded as scanty and unfit for use.

As concerns the packages with truncated cone ends, as the one shown in FIG. 1, and constant a angle, the winding tension average value decreases with the increase in the external diameter D and consequent decrease in l, i.e. in the stroke of the yarn cross-winding device. This involves a reduction in the yarn bundling specific weight, the other yarn characteristics remaining the same. The variation of the yarn bundling specific weight with varying the external diameter D is a linear function of the latter value.

Therefore, on a specific weight (SW)-diameter D plot, said variation is represented by a straight line. The straight line inclination is constant with constant and predetermined working conditions of the winding frame (preset $\alpha$ angle).

Figure 3:
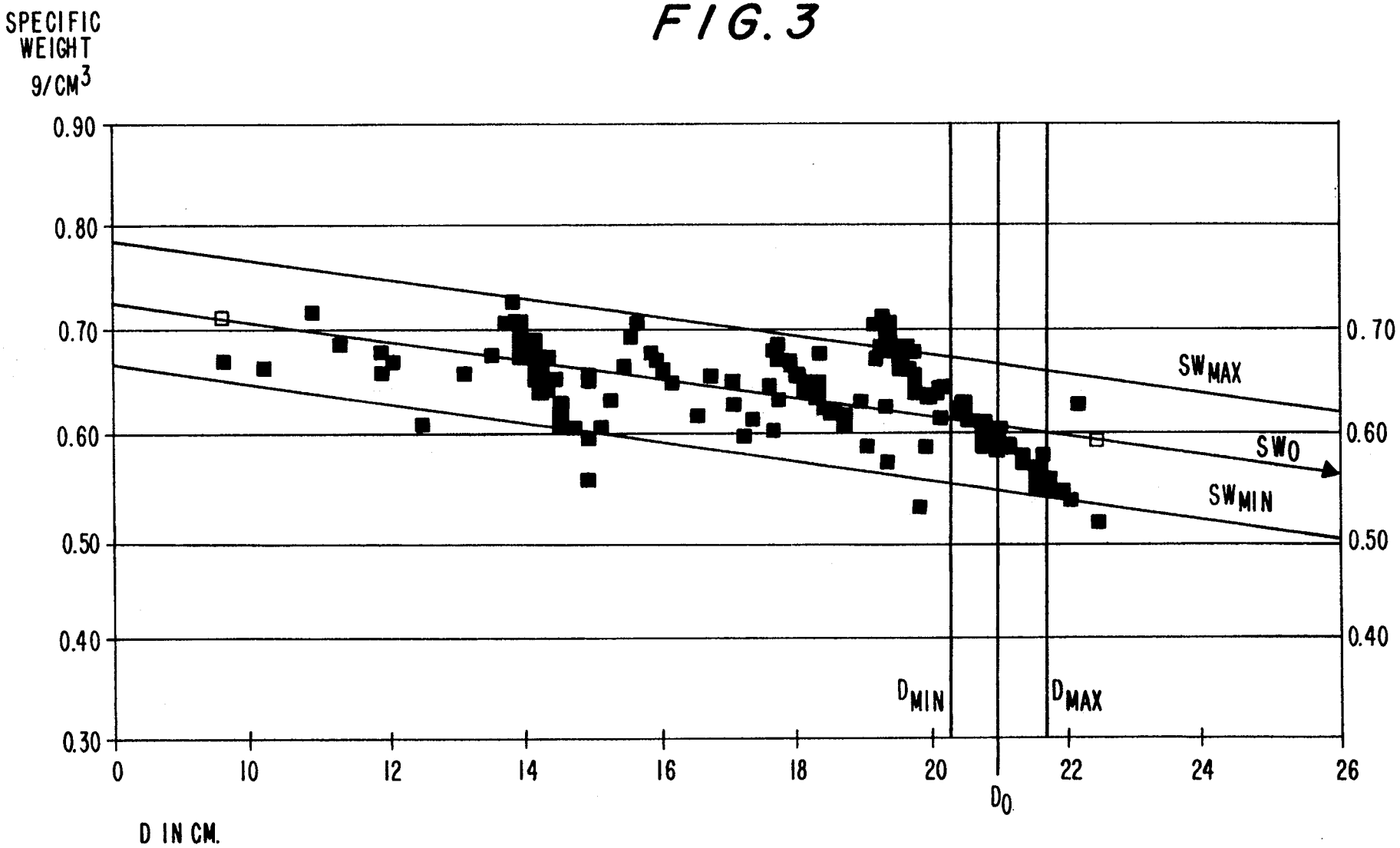
FIG. 3 is a graph illustrating the measured specific weight and hardness values of approximately 190 packages of 56/24 three-filament glassy yarn.

The specific weight SW and external diameter D values measured on approx. 190 packages of 56/24 three-filament glossy yarn are plotted in FIG. 3. The working conditions of the winding frame were such that the value of l was given by the expression 25.88−0.36 D.

The oblique middle line represents the standard value of specific weight $SW_o$ as a function of diameter D, according to the formula $SW_o=0.8-0.009$ D. Lines $SW_{max}$ and $SW_{min}$ corresponding to the values of $SW_o+0.055$ and $SW_o-0.055$, respectively, are also shown. The said limit values of the specific weight were fixed on the basis of the package standard weight and diameter and of the respective tolerances.

Finally, the standard value of the external diameter D and the admissible limit values $D_{min}$ and $D_{max}$ equalling $D\pm0.7$ are also shown. The parallelogram with sides $D_{min}$ and $D_{max}$, $SW_{min}$ and $SW_{max}$ defines the area of the predetermined admissible values of D and SW; in other words it represents the packages complying with the predetermined standards and, therefore, forming a quality class to be regarded as homogeneous. The packages with diameter D not falling within the predetermined limit values range are outside the parallelogram area. However, most of them have an adequate specific weight, i.e. between the limit values $SW_{min}$ and $SW_{max}$ and, therefore, are fully satisfactory as to the technological properties of the yarn, in particular the dyeing affinity.

The method envisaged herein, applied to the yarn package production line, is simple, reliable, and practical as regards the packages softing into classes complying with predetermined quality standards.

Apparatus

The scope of this invention also includes the apparatus needed for the performance of the aforesaid tests.

Said apparatus consists of:

1) a frame provided with package spindle, spindle motor, and tachometer for rpm control;

2) suction-type pneumatic yarn conveyor;

3) apparatus for package weighing and external diameter determination;

4) motor for yarn unwinding and yarn tension controller;

5) knots counting device;

6) visual or automated control of filaments defects and of other defects, if any.

Software

The control method as per this invention provides that the measuring and detection instruments could be connected to a computer. In this way, the data obtained by said instruments as well as the data entered from a manual keyboard are stored and processed by a computer with the result that the product being examined is classified and sorted into predetermined quality classes.

Figure 4:
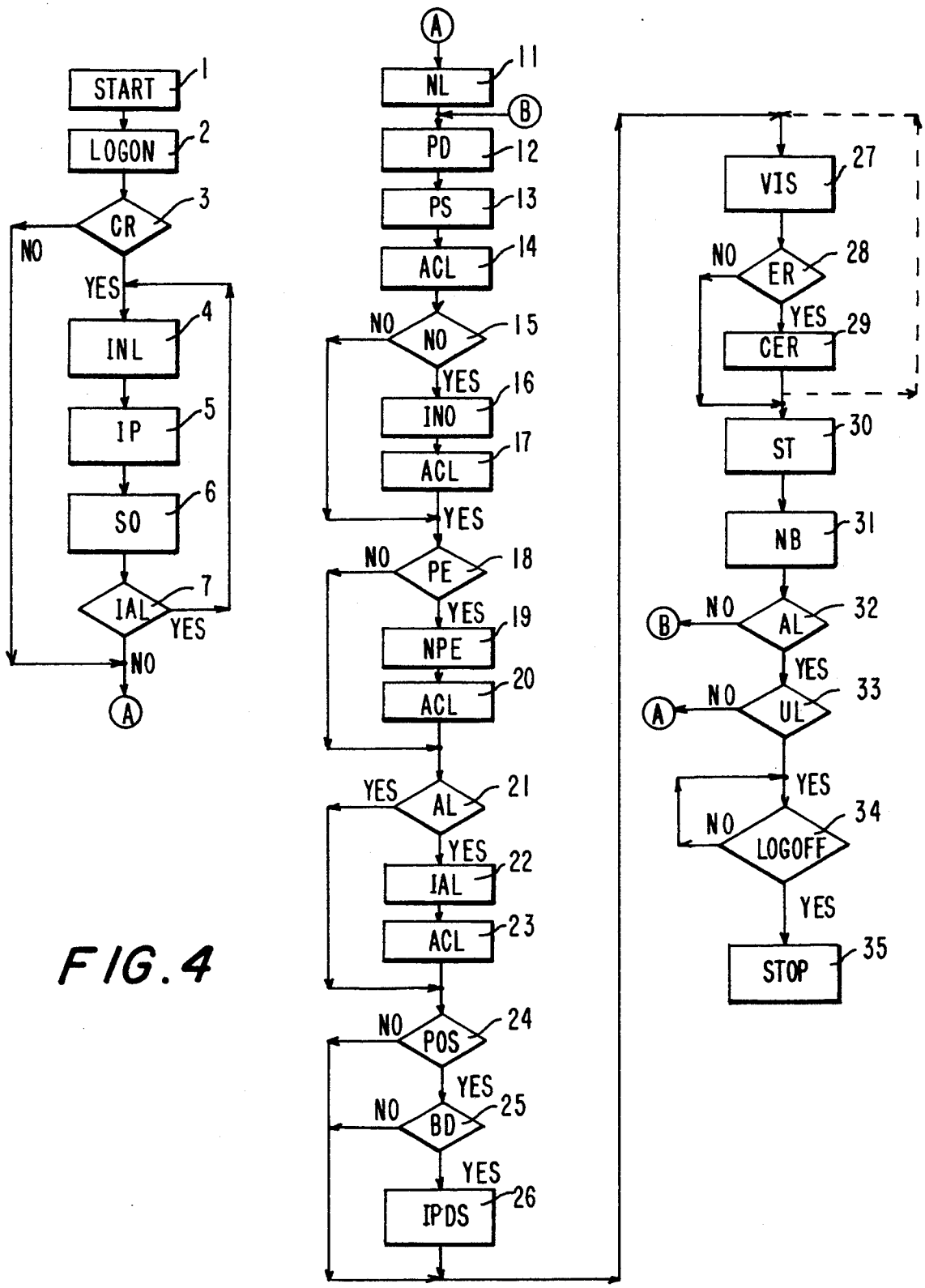
FIG. 4 is a flow chart illustrating a preferred "logic process" followed by a computer to detect the characteristics of the package under examination and to sort it into the quality class corresponding to the detected characteristics.

FIG. 4 shows, as a non-restrictive example, the simplified flow chart illustrating a preferred "logic process" followed by the computer to detect the characteristics of the package under examination and to sort it into the quality class corresponding to the detected characteristics.

For clarity's sake, the flow chart attached hereto has been divided into two parts:

an initialization part (steps from 1 to 7), the access to which is allowed only to authorized personnel (e.g. a foreman), meant for storing—in a protected area—the initialization parameters of a new lot (which are requested by the computer for package testing and classification and which will be described in detail hereinafter), for checking (and, if necessary, updating) the stored parameters of previous lots and, in case, for clearing the parameters relating to already examined and classified lots;

an executive part (steps from 11 to 35) (the access to which is allowed to the operator authorized to use the control apparatus described above, and, more generally, to non-qualified personnel whose access to the protected area containing the initialization parameters is forbidden) enabling the determination of the package characteristics and the classification of same. In the abovesaid part, the operator can exclusively recall the parameters from the protected area and, if necessary, load into a work area the parameters relating to each package, detected by the control procedure, as well as the relevant class. In any case, he cannot modify the protected area contents.

The flow chart of FIG. 4 is going to be examined in detail.

After the computer start up (step 1, START) or, in case, after connection to a computing centre or to a computer of convenient size utilized in time sharing, an access code or a keyword is entered (step 2, LOGON), preferably from a keyboard or an equivalent input device. If the computer realize (step 3, CR) that the said code does not allow the access to the protected area containing the initialization parameters, the process would pass to the executive part (step 11, NL). Otherwise, the contents of the protected area is evidenced, at least partially, on a display: the said contents may be cleared and/or modified from the keyboard.

In a preferred embodiment, the protected area is organized as a matrix whose "rows" or "columns", identified by the lot number, represent the initialization parameters of each lot, and the initialization procedure is subdivided into three steps (step 4, 5, 6).

Within the scope of this invention it is also possible to modify the protected area organization and/or the number and sequence of the initialization steps and/or to change the type and number of the parameters related with each stored lot.

According to the flow chart shown in FIG. 4, the lot number is first entered into the computer (step 4, INL) to retrieve the relevant parameters from the memory. In the case of a new lot, the number and relevant parameters are input in a fixed sequence.

In the subsequent step (step 5, IP), the main parameters of the lot are entered (or modified). In a preferred form of execution, the said parameters are at least the following: package total length L, reel diameter d, angle $\alpha$ (FIG. 1), and package theoretical external diameter $D_o$. (It is to be noted that from said parameters the external length $l_o$ and the specific weight $SW_o$ of a package with external diameter $D_o$) can easily be obtained as linear functions of the external diameter D.

Furthermore the admissible differences (FIG. 3) from the theoretical external diameter $D_o$ and the theoretical specific weight $SW_o$ as well as the value ranges of said parameters, which identify the quality class to be assigned to each package are entered into the computer. The executive part illustrated in the flow chart of FIG. 4 includes a few optional tests that, in the embodiment described herein, envisage the checking of the number of knots/m, of the degree of hairiness of the product as well as other defects, if any (soiled or crushed or otherwise damaged package, etc.), and the determination of the position of the faulty package (in the lot and/or on the winding frame). Therefore, the initialization procedure envisages (step 6, SO) the coding of value fields controlling the execution of each optional test and the storage, if required, of the relevant value ranges.

After completing the initialization of one lot, if another lot (step 7, IAL) must be initialized, the process comes back to step 4 (INL); otherwise, the process goes to the programme executive part that, in the embodiment shown in FIG. 4, consists in an orderly sequence of "steps" including the optional tests that, as will be illustrated in detail hereinafter, may be omitted, if necessary.

Within the scope of this invention, the software packages relating to the optional tests may be envisaged to be resident into the program memory, to be retrieved by the operator, and received by the system in the order requested, once or more times, provided that the relevant control fields of the corresponding protected area have been coded (step 6, SO).

At the start of the programme executive part (step 11, NL), the system requests the operator to input through the keyboard the number of the lot to be examined, the initialization parameters of same being recalled automatically from the corresponding protected area.

From an apparatus according to this invention, the system receives (step 12, PD) the values of weight W and external diameter D of the package being examined, calculates (step 13, PS) the package volume and specific weight SW, and compares the values detected with the parameters previously received (step 11) to sort the package (step 14, ACL) into the quality classes it might belong to on the basis of the detected values.

If the control procedure request so (step 15, NO) and the relevant control field is duly encoded (step 6), the system receives—from a proper sensor or from the keyboard (step 16, INO)—the number of knots/m and checks (step 17, ACL) whether the said number falls within the range provided at least for one of the quality classes determined in previous step 14, while eliminating the quality classes for which the number of knots does not fall within the fixed range.

If the control procedure requests so (step 18, PE) and the relevant control field is duly encoded (step 6), the system requests the operator to input from the keyboard (step 19, NPE) the hairiness degree of the package under examination (detected by visual control or by optical scanner or similar instrument) and checks (step 20, ACL) whether the said hairiness degree falls within the range provided for at least one of the quality classes determined in the preceding steps (step 14 or step 17), while eliminating the quality classes for which the hairiness degree does not fall within the fixed range.

If the control procedure requests so (step 21, AL) and the relevant control field is duly encoded (step 6), the system requests the operator to input from the keyboard (step 22, IAL) the other defects, if any (soiled or crushed or otherwise damaged package, etc.), detected by visual control, while eliminating, if so required, the quality classes determined in the preceding steps (step 14, or step 17, or step 20), in which the presence of the detected defects is not allowed.

If the control procedure request so (step 24, POS) and the relevant control field is duly encoded (step 6), and if defects in the package under examination are detected (step 25, BD) the system requests the operator to input from the keyboard (step 26, IPOS) the position (in the lot and/or on the winding frame) of the faulty package. The recording of the position of the faulty package, if any, offers the advantage of pointing out breakdowns or malfunctions, if any, of one or more parts of the production apparatus.

After completing the package testing, the data detected during the examination are displayed (step 27, VIS) and controlled by the operator. If the operator checks (step 28, ER) that one or more data are either missing or incorrect, he corrects from the keyboard (step 29, CER) the errors found. The control procedure can be repeated several times; in the figure, said possibility is represented by the broken line connecting the output point of functional block 29 with the input of functional block 27.

After correction, if any, the data obtained by package control can be stored in a "historic file" (step 30, ST) and, in case, processed for statistical purposes: this further option is represented in the figure by a broken line.

The weight sensor can detect and signal to the system (step 31, NB) whether the examined package is removed from the testing apparatus and replaced by another package (the detected weight becomes null and, by a sharp fall, negative, to restore to positive). If the operator, upon a system request, does not signal from the keyboard or a proper key (step 32, AL) that the new package belongs to a new lot, the system comes back to step 12 and tests the new package without modifying the lot characteristic parameters previously received. Conversely, after verifying (step 33, UL) that the lot, whose examination has been just completed, is not the last lot to be tested, the system comes back to step 11 and, before starting the control procedure on the new lot, requests the number of the said lot, whose characteristic parameters are to be received.

After completing the examination of the last lot, the system waits (step 34, LOGOFF) for being disconnected from the central processing unit; after that, it is placed to rest (35). Said wait step can be omitted if the system can pass directly from step 33 to step 35. Special attention is to be given to the following:

the simplified flow chart of FIG. 4 does not show all the control steps—which are obvious for a skilled man—meant for preventing the consequences derived from the operator's mistakes, if any (for example, if a wrong lot number, i.e. not corresponding to a protected area, is typed in step 11 NL, the system would display an error message and request that a new lot number be entered);

within the scope of this invention, the flow chart proposed herein can be modified as suggested by experience, and adjusted to meet the specific requirements of the plant where the apparatus set up according to this invention will operate.

I claim:

1. Method for on-line process control of yarn package classification and yarn package sorting into homogeneous classes of predetermined quality standards, the method consisting essentially of:

a) determination of the value of specific weight of the yarn package; and b) utilization of the said value to check the yarn package compliance with preset standard values of dyeing affinity of fabric constructed of yarn of the yarn package.

2. Method, as per claim 1, envisaging the determination of the specific weight from:

a) determination of the value of yarn package weight;

b) determination of yarn package external diameter; and c) calculation of the specific weight as a function of the yarn package weight and the yarn package external diameter.

3. Method, as per claim 1, which comprises the following further analytical determinations:

a) value of number of knots/meter (interlacing);

b) value of filaments defects by visual or automatic control;

c) value of hardness of the yarn packages; and the utilization of the said values to check the yarn package compliance with preset standard values of dyeing affinity of fabric to be obtained from the yarn package.

* * * * *